US009894945B2

(12) United States Patent
Fredrickson

(10) Patent No.: US 9,894,945 B2
(45) Date of Patent: Feb. 20, 2018

(54) HOSPITAL DAY GOWN

(71) Applicant: Janice Fredrickson, Medina, MN (US)

(72) Inventor: Janice Fredrickson, Medina, MN (US)

( * ) Notice: Subject to any disclaimer, the term of this patent is extended or adjusted under 35 U.S.C. 154(b) by 0 days.

(21) Appl. No.: 15/414,062

(22) Filed: Jan. 24, 2017

(65) Prior Publication Data

US 2017/0196282 A1 Jul. 13, 2017

Related U.S. Application Data

(63) Continuation of application No. 14/147,957, filed on Jan. 6, 2014, now abandoned.

(60) Provisional application No. 61/748,852, filed on Jan. 4, 2013.

(51) Int. Cl.

| | |
|---|---|
| ***A41D 13/12*** | (2006.01) |
| ***A41D 27/08*** | (2006.01) |
| ***A41D 27/20*** | (2006.01) |

(52) U.S. Cl.

CPC ..... *A41D 13/1236* (2013.01); *A41D 13/129* (2013.01); *A41D 27/08* (2013.01); *A41D 27/205* (2013.01); *A41D 2300/32* (2013.01); *A41D 2300/324* (2013.01); *A41D 2300/33* (2013.01); *A41D 2400/44* (2013.01)

(58) Field of Classification Search

CPC .. A41D 13/12; A41D 13/129; A41D 13/1236; A41D 13/1281; A41D 27/205; A41D 2300/32; A41D 2300/33; A41D 2300/324; A41D 2400/44

USPC ..... 2/114

See application file for complete search history.

(56) References Cited

U.S. PATENT DOCUMENTS

| | | | | | |
|---|---|---|---|---|---|
| 2,768,383 | A | * | 10/1956 | De Witt | A41D 13/1236 2/114 |
| 3,276,036 | A | * | 10/1966 | Cater | A41D 13/1236 2/114 |
| 3,490,072 | A | * | 1/1970 | Keltner | A41D 13/1236 2/114 |
| 4,296,497 | A | * | 10/1981 | Herman | A41D 13/1236 2/114 |
| 4,570,268 | A | * | 2/1986 | Freeman | A41D 13/1236 2/114 |
| 4,686,715 | A | * | 8/1987 | Price | A41D 13/1236 2/114 |
| 4,718,124 | A | * | 1/1988 | Sawicki | A41D 13/129 2/114 |
| D305,575 | S | * | 1/1990 | Gordon | D2/720 |
| 4,964,173 | A | * | 10/1990 | Gordon | A41D 13/1236 2/114 |
| D336,968 | S | * | 7/1993 | Russano | D2/720 |

(Continued)

*Primary Examiner* — Richale Quinn
*Assistant Examiner* — Anne Kozak
(74) *Attorney, Agent, or Firm* — Zollinger & Burleson Ltd.

(57) ABSTRACT

A hospital gown closes along the side and across the rear of the shoulder of the person wearing the gown. The side closure combined with different arm closures allows the gown to be used by the patient and the medical staff in different ways. The gown can be placed onto the patient without requiring the patient to sit up. The gown can be draped over the patient like a blanket. The gown can be removed from a patient while the patient is lying down in bed. The side opening of the gown allows the gown to be placed over a patient who is lying on his back without immediately wrapping the gown around the patient's body. When the patient is up and walking, the side closure and a long waist tie provide modesty.

11 Claims, 7 Drawing Sheets

(56) References Cited

U.S. PATENT DOCUMENTS

| | | | | | |
|---|---|---|---|---|---|
| 5,228,141 | A * | 7/1993 | Remsky | A41D 13/1236 | 2/114 |
| 5,991,923 | A * | 11/1999 | Maria | A41D 13/1236 | 2/114 |
| 6,216,271 | B1 * | 4/2001 | Chen | A41D 13/1245 | 2/114 |
| 6,237,153 | B1 * | 5/2001 | Bowens | A41D 13/1236 | 2/114 |
| 6,460,187 | B1 * | 10/2002 | Siegel | A41D 13/1245 | 2/114 |
| D584,483 | S * | 1/2009 | Glynn | D2/720 | |
| D622,479 | S * | 8/2010 | Herzog | D2/720 | |
| D624,280 | S * | 9/2010 | Halseth | D2/720 | |
| D636,558 | S * | 4/2011 | Shelton | D2/720 | |
| D656,710 | S * | 4/2012 | Farris | D2/720 | |
| D657,529 | S * | 4/2012 | Farris | D2/720 | |
| D657,530 | S * | 4/2012 | Farris | D2/720 | |
| 8,646,114 | B1 * | 2/2014 | Williams | A41D 13/1236 | 2/114 |
| D721,869 | S * | 2/2015 | Bernier | D2/720 | |
| 2005/0070191 | A1 * | 3/2005 | Kempe | A41D 13/1236 | 442/316 |
| 2013/0131617 | A1 * | 5/2013 | Kovensky | A41D 13/1281 | 604/327 |
| 2013/0276202 | A1 * | 10/2013 | Forbes | A41D 13/1236 | 2/114 |

* cited by examiner

HOSPITAL DAY GOWN

CROSS REFERENCE TO RELATED APPLICATIONS

This application is a continuation of U.S. patent application Ser. No. 14/147,957 filed Jan. 6, 2014, which claims the benefit of U.S. provisional patent application Ser. No. 61/748,852 filed Jan. 4, 2013; the disclosures of both are incorporated herein by reference.

BACKGROUND OF THE DISCLOSURE

1. Technical Field

This disclosure relates generally to hospital gowns worn by patients and, more particularly, to a hospital day gown having features that improve patient comfort and patient care as well as making patient care easier for the health care provider.

2. Background Information

Despite countless attempts to improve the dreaded patient hospital gown, room for improvement remains in the art to provide a gown that benefits both the patient and the healthcare workers providing care to the patient. Many hospital day gowns tie up in the center of the back of the patient while almost never providing enough coverage to protect the patient's modesty. Gowns that tie in the back are difficult to don while lying in a bed and make it difficult for the healthcare workers to access the patient's arms and other medical equipment in front of the patient.

SUMMARY OF THE DISCLOSURE

The disclosure provides a hospital gown that closes along the side and across the rear of the shoulder of the person wearing the gown. The side closure combined with different arm closures allows the gown to be used by the patient and the medical staff in different ways. The gown can be placed onto the patient without requiring the patient to sit up. The gown can be draped over the patient like a blanket. The gown can be removed from a patient while the patient is lying down in bed. The side opening of the gown allows the gown to be placed over a patient who is lying on his back without immediately wrapping the gown around the patient's body. When the patient is up and walking, the side closure and a long waist tie provide modesty.

The side-opening gown allows the front of the gown to be lifted to provide access to the front of the patient. This allows medical caregivers visual access to surgical sites, drain sites, and provides access to central line intravenous sites. The side-opening gown can be opened even when the patient is lying on the rear portion of the gown. This gown also provides access to both arms because both sleeves can be fully opened.

The gown has a body with front and rear portions with side closure edges that come together under a first sleeve of the gown and across the back of the shoulder behind the first sleeve. The side closure edges may overlap especially behind the shoulder. The first sleeve drapes over the wearer's arm and is selectively closed with fasteners under the arm. The gown's second sleeve is selectively closed over the top of the arm. The sleeves can be opened to provide access to the patient's arms and to accommodate tubes and intravenous lines.

In one configuration, the gown includes a telemetry pocket that is disposed over an opening in the front portion of the gown body for the telemetry wires. A second pocket may be provided in a lower section of the front portion of the gown body. The second pocket may be used as a regular pocket to hold personal items of the patient. The second pocket also can be used to hold a drainage bag and is thus disposed on the closure side of the front portion of the gown body so that drainage tubes can extend from behind the gown between the closure edges of the gown body The gown may be provided in different sizes that have different colors for rapid identification. Some gowns may be provided in a different color that identifies a patient condition such as a fall risk.

BRIEF DESCRIPTION OF THE DRAWINGS

Similar numbers refer to similar parts throughout the specification.

DETAILED DESCRIPTION OF THE DISCLOSURE

Figure 1:
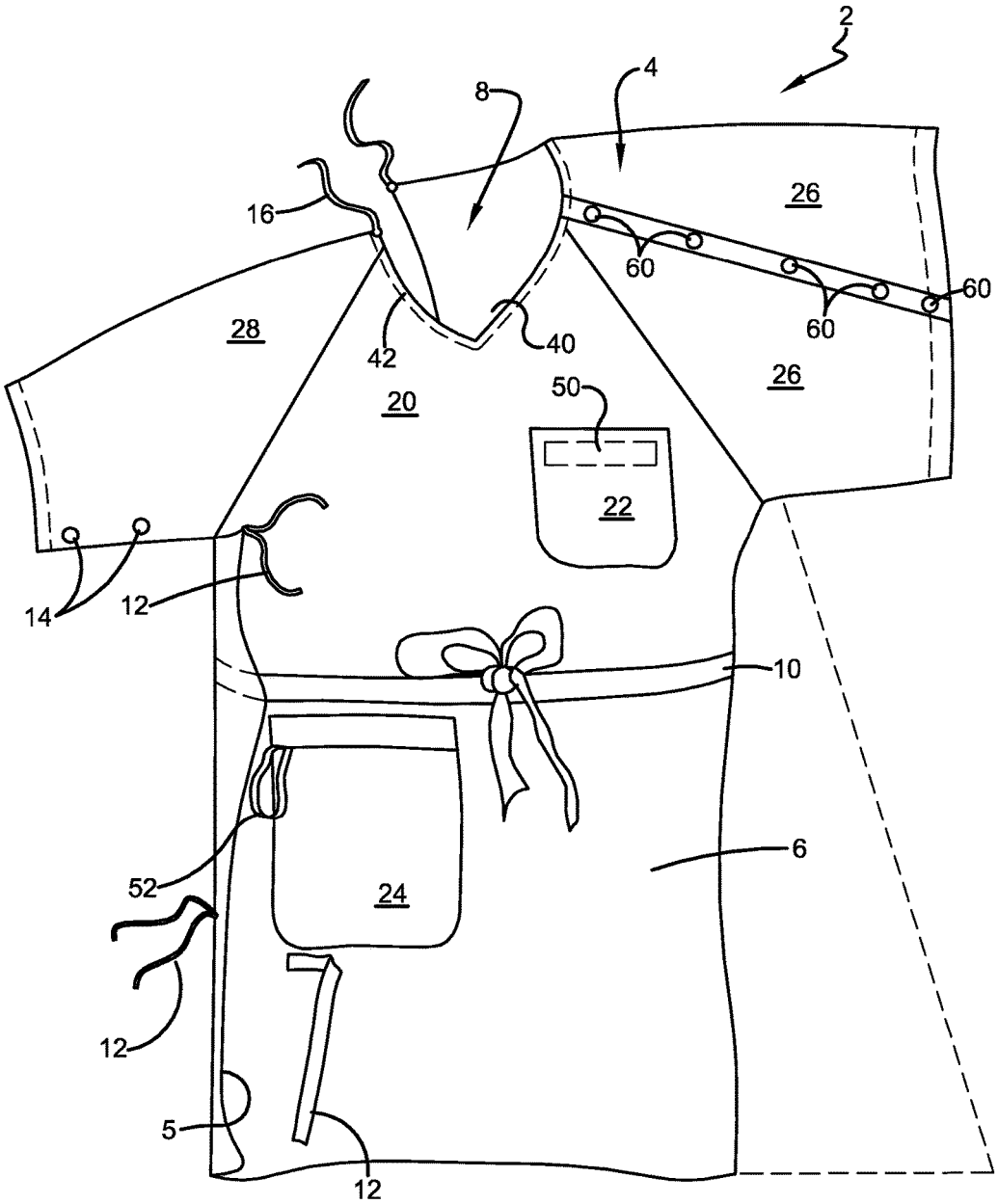
FIG. 1 is a front plan view of an exemplary hospital day gown having the features described herein.
Figure 2:
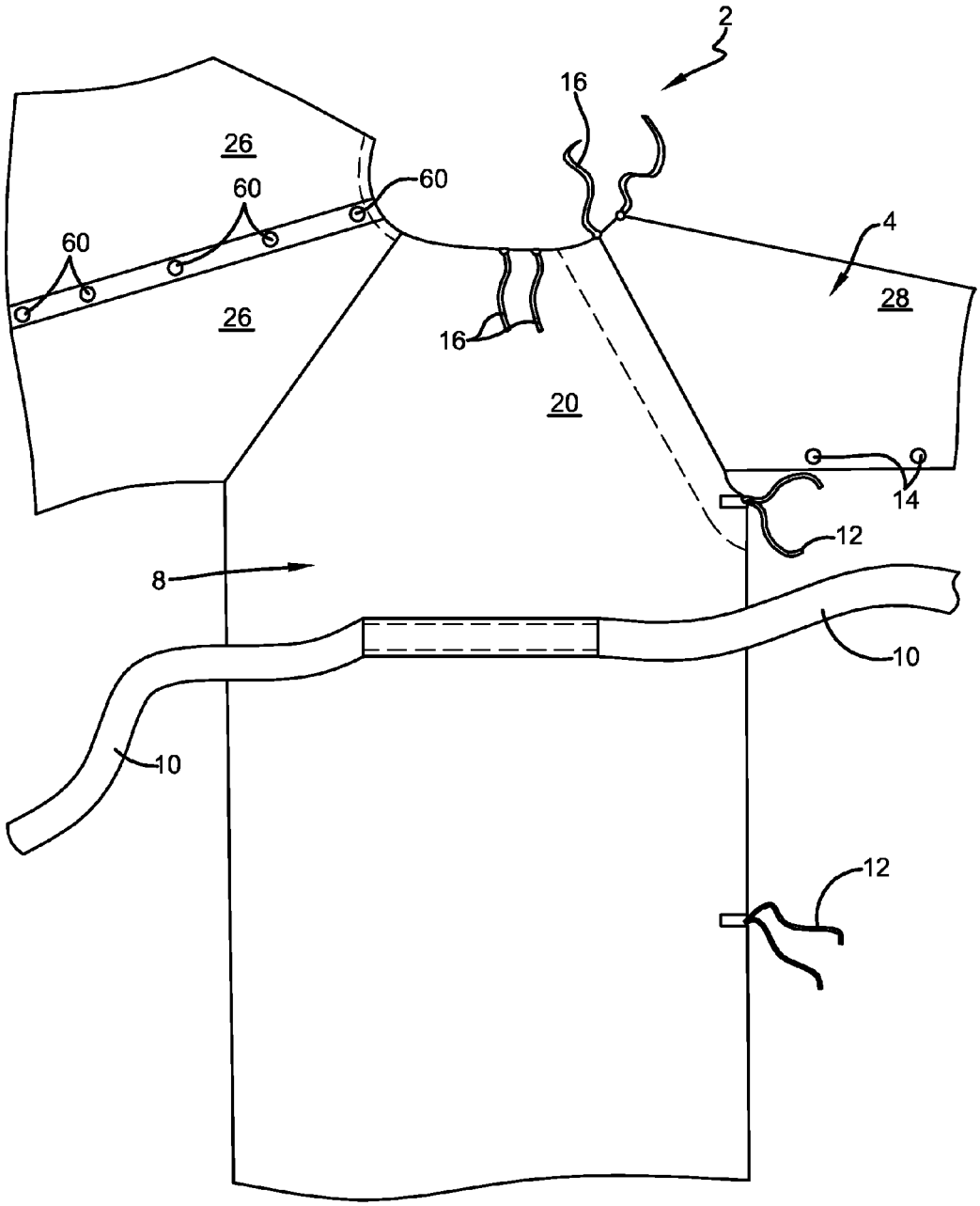
FIG. 2 is a rear plan view of the exemplary hospital day gown shown in FIG. 1.
Figure 3B:
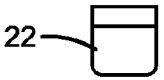
FIGS. 3A-3F are plan views of the different sections of material used to assemble the hospital day gown of FIGS. 1 and 2.
Figure 3C:
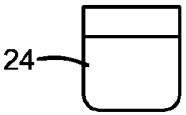
Figure 3D:
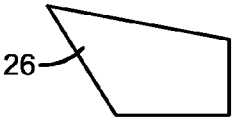
Figure 3E:
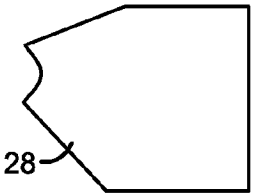
Figure 3A:
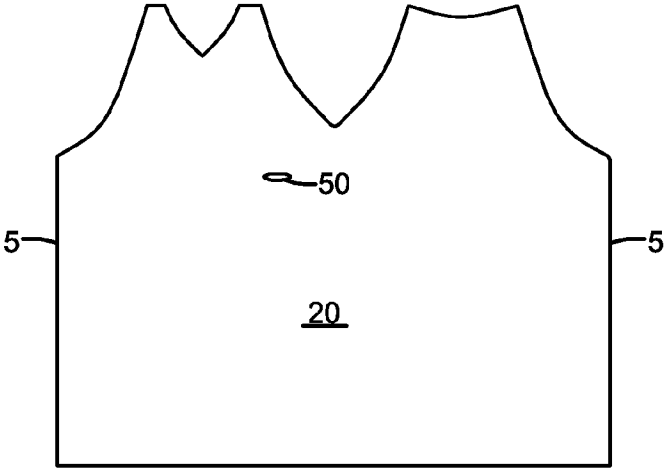
Figure 3F:
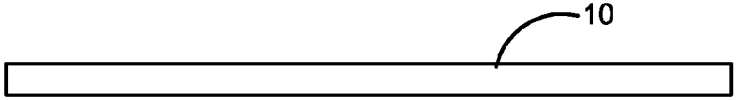
Figure 4:
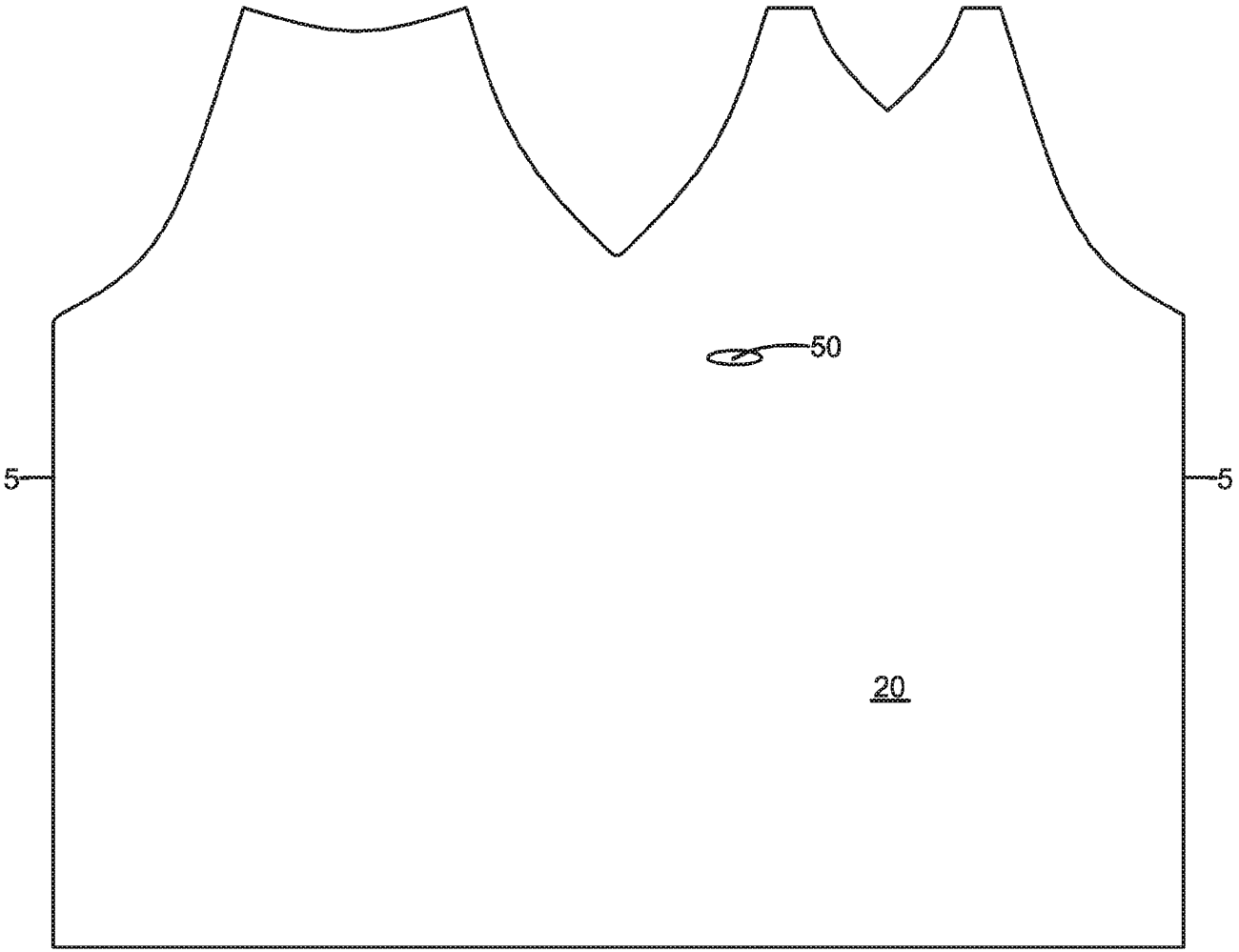
FIG. 4 is a front plan view of the body of the gown.

A first exemplary configuration of a hospital gown is indicated generally by the numeral 2 in the accompany drawings. Gown 2 generally includes a gown body 4 having a front portion 6 and a rear portion 8 that each has a closure edge 5. Gown body 4 is configured to have the closure edges 5 meet at the patient's side and under a sleeve. The closure edges extend from the bottom of the sleeve up and across the rear of the patient's shoulder to the neck opening. The portions of gown body 4 behind the patient's shoulder are configured to overlap as shown in FIG. 2. The side-fastening configuration of gown 2 makes it easy for a healthcare provider to put gown 2 on the patient when the patient is lying in a bed because gown 2 can be put on the patient by rolling or tilting the patient onto one side and slipping the rear portion of gown 2 under the patient. When the patient is returned to his back, front portion 6 is draped over the front of the patient and can be fastened at the patient's side with side ties 12, sleeve fasteners 14, and a neck tie 16. Ties 12 and 16 may be ⅝ inch cotton, poly, or poly blend twill tape. An extra tie 12 may be provided inward of closure edge 5 on front portion 6 to provide adjustability. Multiple neck ties 16 may be provided about the neck opening to provide adjustability. The fasteners may be snaps, buttons, ties, strips of hook-and-loop fastener materials and the like.

Gown 2 includes a long tie 10 that is fastened (stitched along ten to twelve inch portion) to rear portion 8. Tie 10 may be sixty-six inches (and two or two and a half inches wide) to provide plenty of length to tie in the front of most patients. Tie 10 may be provided in longer lengths with the extra-large size gowns 2. Tie 10 may be formed from a double layer of fabric. Tie 10 may be pulled around the patient's waist to provide an attractive look and avoids the tent look of a typical gown.

Gown 2 is provided in different sizes. A first size covering those patients whom wear small- and medium-sized clothing and a second size for those patients whom wear large- and extra large-sized clothing. The sizes are color coded, provided in different patterns, or combinations of colors and patterns so the staff can readily separate the gowns and pull the correct size gown for a patient without looking at labels. A third size may be provided in a still different color or pattern (or combination of both) for larger patients. In addition, all size gowns may be provided with a different color or different pattern (or combination of both) to be used with patients who are fall risks so that such patients can be readily identified by any caregiver working with or encountering the patient. In one exemplary configuration, the first size may be a blue print (or a blue fabric), the second size may be a green print (or a green fabric), and the fall risk gowns may be provided in red (pattern or fabric).

Figure 5:
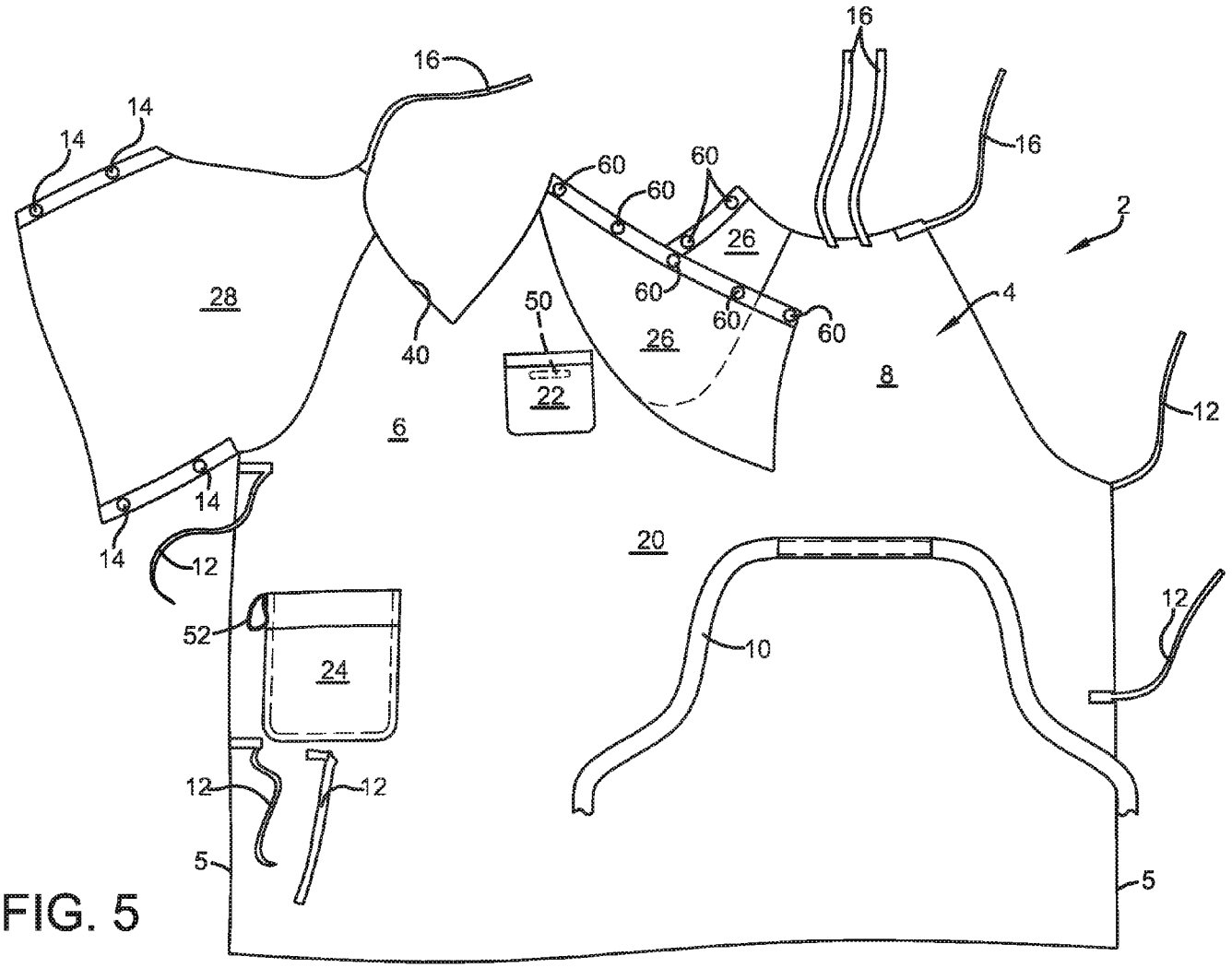
FIG. 5 is a front plan view of the hospital day gown opened up and spread flat.

Gown 2 is formed from seven or eight parts as shown in FIGS. 3A-F. The parts are sewn together as shown in FIG. 5 to define gown body 4. The parts include a body section 20 (which can be provided in one or two parts) which defines front portion 6 and rear portion 8, a small pocket 22, a large pocket 24, a pair of left sleeve sections 26, a right sleeve 28, and belt tie 10. All of the parts may be formed from a durable washable fabric such as a cotton-polyester blend (45/55 or 65/35).

Body 4 has a V-shaped neck opening 40 which immediately allows the user to determine which side of gown 2 is the front. The V-neck may be lined or edged with a liner tape 42 such as a twill tape. This tape 42 may be a bright color to help identify the front of gown 2. The V-neck 40 reduces the problem of the gown pinching the patient's neck when the patient sits or lies on the gown and pulls the front of the gown up towards the patient's neck.

Small pocket 22 is used with telemetry patients. Body section 20 defines an opening 50 behind small pocket 22 to allow cardiac wires to be threaded through body section 22 into the pocket formed by small pocket 22 so that a transmitter can be carried in small pocket 22. Pocket 22 may be disposed on the patient's right side or the patient's left side. Opening 50 can be horizontal or vertical.

Large pocket 24 is used to allow the patient to carry miscellaneous items when the patient is ambulating. Large pocket 24 also is used to carry a drainage bag or can carry the drainage bag on a drain loop 52 with a hook. Pocket 24 is disposed on the side of front portion 6 that terminates at the closure edge. Drain loop 52 is marked as "Drain Loop" so it is not tied or used for something else. The tubing can be threaded out of the right-side opening of gown 2. Drain loop 52 can hold the drain tubing. Large pocket 24 may be branded with the manufacturer logo or the facility logo. An additional twill tape tie 12 may be provided at the bottom of pocket 24 to help hold the edge of gown 2 closed.

Figure 6:
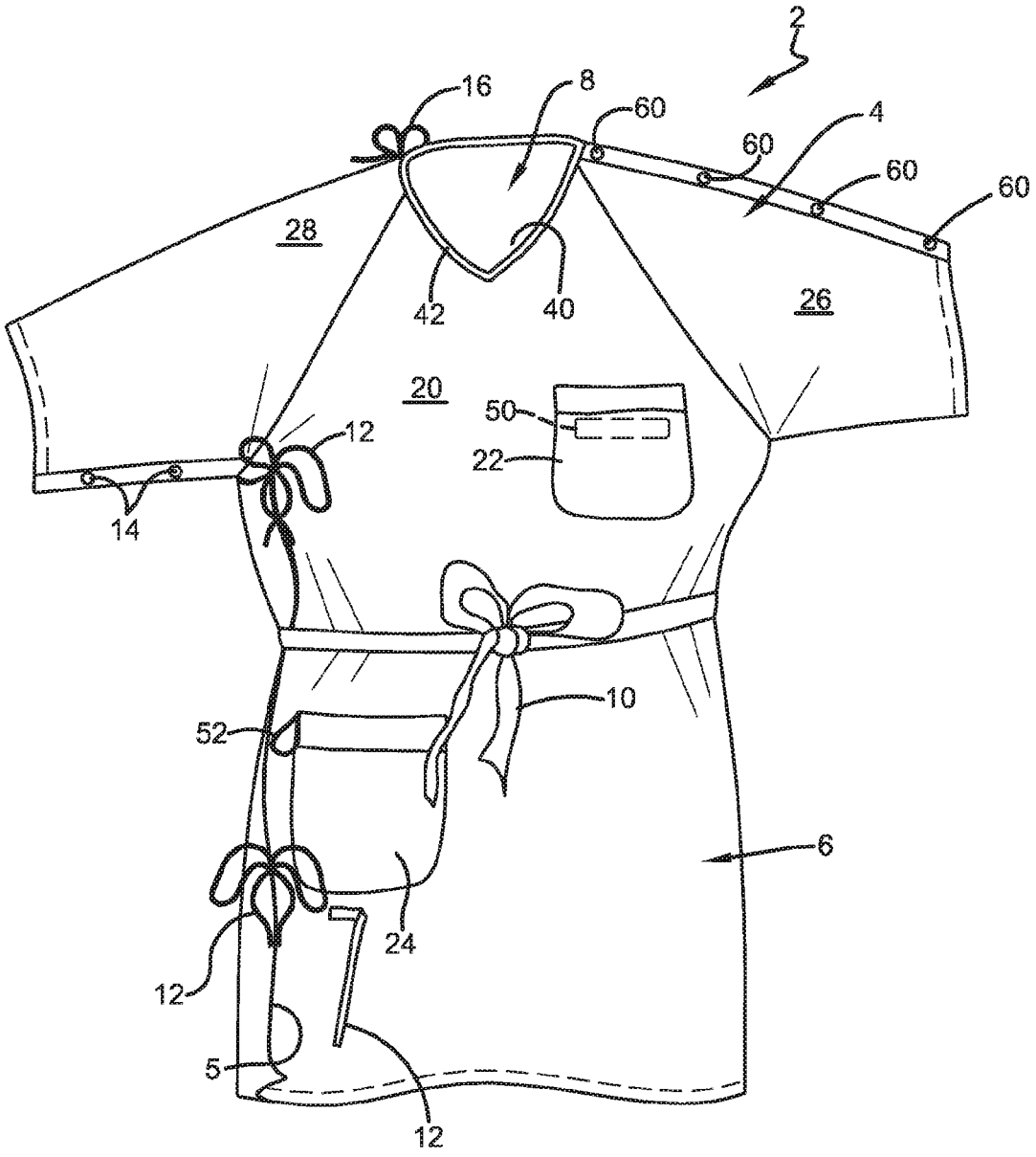
FIG. 6 is a front view of the hospital day gown with the sleeves closed as when worn by a patient.
Figure 7:
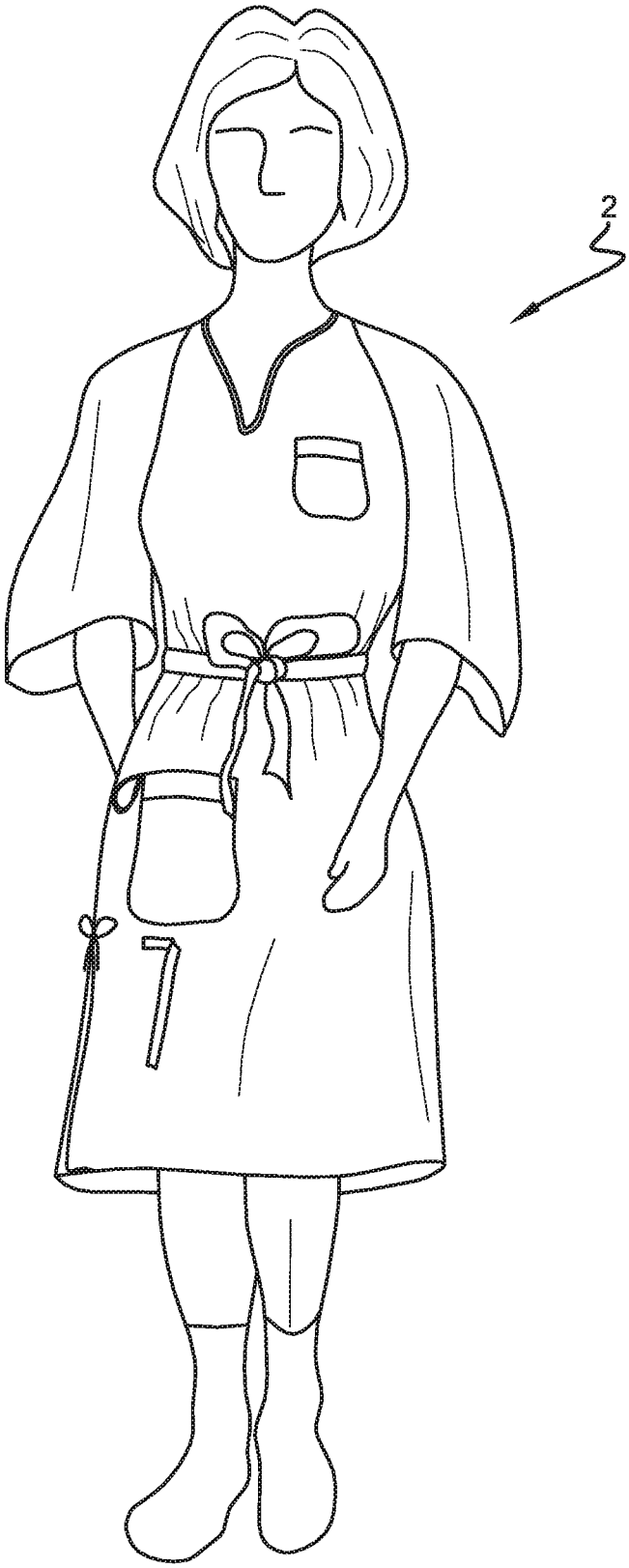
FIG. 7 is a front view of a person wearing the hospital day gown of the disclosure.

Gown 2 is configured to allow access to both of the patient's arms because both sleeves 26 and 28 open along their lengths and selectively fasten with fasteners 14 and 60. These fasteners are typically snaps but may be ties similar to ties 12 or 16. These fasteners 14 and 60 allow gown 2 to be removed and replaced without interfering with intravenous tubing. In FIGS. 5 and 6, the last corner snap 60 at the bottom the sleeve may be removed. The patient's left sleeve 26 opens along its top and the right sleeve 28 opens along the bottom in line with the right-side opening of gown 2.

The exemplary configuration of gown 2 opens along its right side so that the front of gown 2 may be lifted to provide access to the front of the patient. This allows medical caregivers visual access to surgical sites, drain sites, access central line intravenous sites, and the like. Gown 2 can be opened even when the patient is lying on rear portion 8 and it is not need to access these sites.

Gown 2 can be opened out flat and placed over an immobile patient in a bed. Rear portion 8 can be left to the side of the patient until the patient is in condition to be tilted or rolled to a side and rear portion 8 placed under the patient. This configuration also allows gown 2 to be placed over patient and not tied in place until the patient is ready to have it tied around his body. The patient can lie of his back when gown 2 is tied in place.

Gown 2 opens along the right side but front portion 6 and rear portion 8 overlap so that the patient is covered when ambulating. Rear portion 8 completely covers the rear of patient and thus makes the patient more comfortable and more likely to ambulate.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A gown for a medical patient having a medical condition; the gown comprising: a gown body adapted to be worn by the medical patient; the gown body having a front portion, a rear portion, a first sleeve, and a second sleeve; each of the first and second sleeves having a top edge, a bottom edge, a front, and a rear; the bottom edges of the front and rear of the first sleeve being selectively connectable such that the first sleeve is openable and closable along the bottom of the first sleeve; the second sleeve being openable and closable along the top edges of the front and rear of the second sleeve; the front of the first sleeve being directly connected to the front portion of the gown body; the front and rear portions of the gown body having closure edges that meet under the first sleeve to selectively open and close the gown; the bottom edges of the front and rear of the first sleeve being openable and closable independent of the closure edges of the gown body; the gown body defining a neck opening when the gown is closed; the front portion of the gown body defines a V-shaped portion of the neck opening; the V-shaped portion having fixed dimensions; and the closure edges of the front and rear portions of the gown body including corresponding closure edges at the neck opening to selectively connect and separate the rear of the first sleeve from the rear portion of the gown body such that the first sleeve is separated from the rear portion of the gown body.

2. The gown of claim 1, further comprising a liner strip connected to the gown body along at least a portion of the neck opening.

3. The gown of claim 2, wherein the liner strip is provided in a first color and the gown body is provided in a second color; the first color contrasting with the second color such that the front of the gown may be readily identified.

4. The gown of claim 1, further comprising a first pocket connected to the front portion of the gown body; the front portion of the gown body defining an opening adjacent the first pocket to accommodate access for wire into the pocket from inside the gown.

5. The gown of claim 4, wherein the opening defined by the front portion of the gown body is covered by the first pocket.

6. The gown of claim 1, further comprising a pocket connected to the front portion of the gown body; the pocket disposed on a side of the front portion of the gown body, near the first sleeve.

7. The gown of claim 6, further comprising a loop disposed adjacent an upper corner of the pocket.

8. The gown of claim 1, further comprising a long tie that ties in the front of the gown body; the long tie adapted to wrap around the patient wearing the gown.

9. The gown of claim 8, wherein the long tie is fixed to the rear portion of the gown body.

10. The gown of claim 1, further comprising:

a long tie that ties in the front of the gown body; the long tie adapted to wrap around the patient wearing the gown;

wherein the long tie is fixed to the rear portion of the gown body; and wherein an elongated portion of the long tie is fixed to the rear portion of the gown body with stitching; the elongated portion being at least ten inches and disposed substantially horizontal when the gown is worn by the user.

11. A gown for a medical patient having a medical condition; the gown comprising: a gown body adapted to be worn by the medical patient; the gown body having a front portion, a rear portion, a first sleeve, and a second sleeve; each of the first and second sleeves having a top edge, a bottom edge, a front, and a rear; the bottom edges of the front and rear of the first sleeve being selectively connectable such that the first sleeve is openable and closable along the bottom of the first sleeve; the second sleeve being openable and closable along the top edges of the front and rear of the second sleeve; the front of the first sleeve being directly connected to the front portion of the gown body; the front and rear portions of the gown body having closure edges that meet under the first sleeve to selectively open and close the gown; the bottom edges of the front and rear of the first sleeve being openable and closable independent of the closure edges of the gown body; the gown body defining a neck opening when the gown is closed; and the closure edges of the front and rear portions of the gown body including corresponding closure edges at the neck opening to selectively connect and separate the rear of the first sleeve from the rear portion of the gown body such that the first sleeve is separated from the rear portion of the gown body.

* * * * *